US011560790B2

(12) United States Patent
Ab. Hamid et al.

(10) Patent No.: US 11,560,790 B2
(45) Date of Patent: Jan. 24, 2023

(54) DOWNHOLE LEAK DETECTION

(71) Applicant: Saudi Arabian Oil Company, Dhahran (SA)

(72) Inventors: Abdul Halim Ab. Hamid, Udhailyah (SA); Yousef Al-Salim, Al Umran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/199,715

(22) Filed: Mar. 12, 2021

(65) Prior Publication Data

US 2022/0290555 A1 Sep. 15, 2022

(51) Int. Cl.

| | |
|---|---|
| ***E21B 47/117*** | (2012.01) |
| ***E21B 47/04*** | (2012.01) |
| ***E21B 47/06*** | (2012.01) |
| ***E21B 47/07*** | (2012.01) |

(52) U.S. Cl.
CPC ..... *E21B 47/117* (2020.05); *E21B 47/04* (2013.01); *E21B 47/06* (2013.01); *E21B 47/07* (2020.05)

(58) Field of Classification Search
CPC ..... E21B 47/117; E21B 47/07; E21B 47/04; E21B 47/06
See application file for complete search history.

(56) References Cited

U.S. PATENT DOCUMENTS

| | | | |
|---|---|---|---|
| 1,744,698 | A | 1/1930 | Granger |
| 2,701,960 | A | 2/1955 | Irwin |
| 3,342,061 | A | 9/1967 | Morris |
| 3,696,660 | A | 10/1972 | Hubbard |
| 9,500,057 | B2 | 11/2016 | Al-Rabeh |
| 10,125,602 | B2 | 11/2018 | Al-Hussain et al. |
| 10,392,925 | B2 | 8/2019 | Ang et al. |
| 10,641,079 | B2 | 5/2020 | Aljubran et al. |
| 2010/0089128 | A1 | 4/2010 | Vasshus et al. |
| 2010/0206580 | A1 * | 8/2010 | Tessari ..... E21B 23/10 166/77.51 |

(Continued)

OTHER PUBLICATIONS

"Leak Detection Tool," Peak Well Systems, Well Integrity, brochure, 2019, 1 page.

(Continued)

*Primary Examiner* — Taras P Bemko
(74) *Attorney, Agent, or Firm* — Fish & Richardson P.C.

(57) ABSTRACT

A leak detection tool is positioned in in a tubing string that is disposed in a wellbore. The leak detection tool is attached to a downhole end of a line and includes a cup. An outside diameter of the cup is substantially the same as an inside diameter of the tubing string. An uphole end of the line is attached to a spool disposed proximate to an uphole end of the wellbore. The leak detection tool is propelled through the tubing string in a downhole direction by pumping a fluid down the tubing string such that a fluid pressure uphole of the cup is greater than a fluid pressure downhole of the cup. A flow of fluid from an interior of the tubing string uphole of the cup to an exterior of the tubing string through a leak in a wall of the tubing string is detected as the cup passes the leak. A depth of the leak is determined based on a length of the line from the spool to the leak detection tool when the flow of fluid from uphole of the cup through the leak is first detected.

15 Claims, 4 Drawing Sheets

(56) References Cited

U.S. PATENT DOCUMENTS

| | | | | |
|---|---|---|---|---|
| 2012/0199341 | A1* | 8/2012 | Kellner | E21B 34/14 166/194 |
| 2017/0275987 | A1* | 9/2017 | Al-Hussain | E21B 47/107 |
| 2018/0223651 | A1 | 8/2018 | McDowell et al. | |
| 2018/0283167 | A1* | 10/2018 | Ang | E21B 47/10 |
| 2020/0095861 | A1 | 3/2020 | Camilleri | |
| 2020/0326226 | A1* | 10/2020 | Camacho Cardenas | E21B 19/00 |

OTHER PUBLICATIONS

"A Circulating Plug," Brace Tool, brochure, 215-216, available on or before Sep. 2020, via wayback machine URL <https://web.archive.org/web/20200922132059/https://www.bracetool.com/wireline/a-circulating-plug/11/157>, 2 pages.

PCT International Search Report and Written Opinion in International Appln. No. PCT/US2022/019300, dated May 16, 2022, 14 pages.

* cited by examiner

DOWNHOLE LEAK DETECTION

TECHNICAL FIELD

This disclosure relates to a system and method for leak detection in tubing strings in wellbores.

BACKGROUND

Wells for hydrocarbon production or other applications are completed and made ready for production by cementing a casing within the wellbore and inserting a tubing string (sometimes called production tubing) within the casing. Hydrocarbons or other fluids can be produced from a subterranean formation up the tubing string.

Over time, leaks can develop in the walls of the tubing string. Such leaks can reduce production rates and/or cause other problems with the wellbore equipment and operations.

SUMMARY

This disclosure relates to a system and method for leak detection in wellbores.

Certain aspects of the subject matter herein can be implemented as a method including positioning a leak detection tool in a tubing string disposed in a wellbore. The leak detection tool is attached to a downhole end of a line and includes a cup. An outside diameter of the cup is substantially the same as an inside diameter of the tubing string. An uphole end of the line is attached to a spool disposed proximate to an uphole end of the wellbore. The leak detection tool is propelled through the tubing string in a downhole direction by pumping a fluid down the tubing string such that a fluid pressure uphole of the cup is greater than a fluid pressure downhole of the cup. A flow of fluid from an interior of the tubing string uphole of the cup to an exterior of the tubing string through a leak in a wall of the tubing string is detected as the cup passes the leak. A depth of the leak is determined based on a length of the line from the spool to the leak detection tool when the flow of fluid from uphole of the cup through the leak is first detected.

An aspect combinable with any of the other aspects can include the following features. Detecting the flow of the fluid from uphole of the cup through the leak includes detecting a change in fluid pressure in the interior of the tubing string uphole of the cup.

An aspect combinable with any of the other aspects can include the following features. Detecting the flow of the fluid from uphole of the cup through the leak includes detecting a change in the temperature of fluid flowing in the interior of the tubing string uphole of the cup.

An aspect combinable with any of the other aspects can include the following features. Detecting the flow of the fluid from uphole of the cup through the leak includes detecting a change in a pump rate of the pumping.

An aspect combinable with any of the other aspects can include the following features. Detecting the flow of the fluid from uphole of the cup through the leak includes detecting a change in a weight on the line.

An aspect combinable with any of the other aspects can include the following features. The line is a slickline.

An aspect combinable with any of the other aspects can include the following features. The cup is an elastomer cup.

An aspect combinable with any of the other aspects can include the following features. The fluid is pumped at a substantially constant rate.

An aspect combinable with any of the other aspects can include the following features. The leak detection tool further comprises a circulation port configured to selectively allow fluid to flow from uphole of the cup to downhole of the cup.

An aspect combinable with any of the other aspects can include the following features. The circulation port is closed as the leak detection tool is propelled in the downhole direction. The circulation port is opened after the depth of the leak is detected. The leak detection tool is pulled in an uphole direction with the line.

Certain aspects of the subject matter herein can be implemented as a system including a leak detection tool disposed in a tubing string in a wellbore. The leak detection tool includes a cup having an outside diameter of the cup that is substantially the same as an inside diameter of the tubing string. The leak detection tool also includes a circulation port configured to selectively allow fluid to flow from uphole of the cup to downhole of the cup and a sensor unit disposed on the tool uphole of the cup and including one or more sensors. The system also includes line having an uphole end and a downhole end, wherein the uphole end is attached to a spool disposed proximate to an uphole end of the wellbore and the downhole end is attached to the leak detection tool. The system also includes a pump to pump fluid into the tubing string uphole of the leak detection tool and thereby propel the leak detection tool through the tubing string in a downhole direction and past a leak in the tubing string.

An aspect combinable with any of the other aspects can include the following features. The sensor unit includes a pressure sensor configured to measure a pressure of the fluid in an interior of the tubing string uphole of the leak detection tool.

An aspect combinable with any of the other aspects can include the following features. The sensor unit includes a temperature sensor configured to measure a temperature of fluid flowing in the interior of the tubing string uphole of the cup in an exterior of the tubing string.

An aspect combinable with any of the other aspects can include the following features. The system also includes a line weight sensor configured to measure the weight of the line and leak detection tool as the leak detection tool is propelled downhole.

An aspect combinable with any of the other aspects can include the following features. The line is a slickline.

An aspect combinable with any of the other aspects can include the following features. The cup is an elastomer cup.

An aspect combinable with any of the other aspects can include the following features. The leak detection tool includes a mandrel attached to the cup, and the line is attached to an uphole end of the mandrel.

An aspect combinable with any of the other aspects can include the following features. The system includes a jar-activated shear pin operable to open the circulation port.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

A leak across production tubing may occur due to many reasons, such as a wall loss as a result of corrosion in production tubing, a poor connection make-up, a tubing collapse due to excessive pressure introduced from inside the tubing-casing annulus, and/or other reasons. Production tubing leaks can reduce production, cause delays, create hazardous conditions, and/or cause other problems.

Tubing string leaks can be detected by installing and setting a mechanical plug downhole of the leak and testing the string by increasing the hydrostatic pressure within the tubing string and deploying a wireline tool to detect pressure and temperature changes. Tubing string leaks can also be detected utilizing electronic devices and methods such as acoustic logging tools. Such existing methods of leak detection can be complicated and involve many moving parts or sensitive and expensive electronic or mechanical components.

The method, tool, and system of the present disclosure can detect the presence and location (depth) of tubing string leaks using a robust, simple device with a small number of moving parts and a fast, reliable, and economical method.

Figure 1:
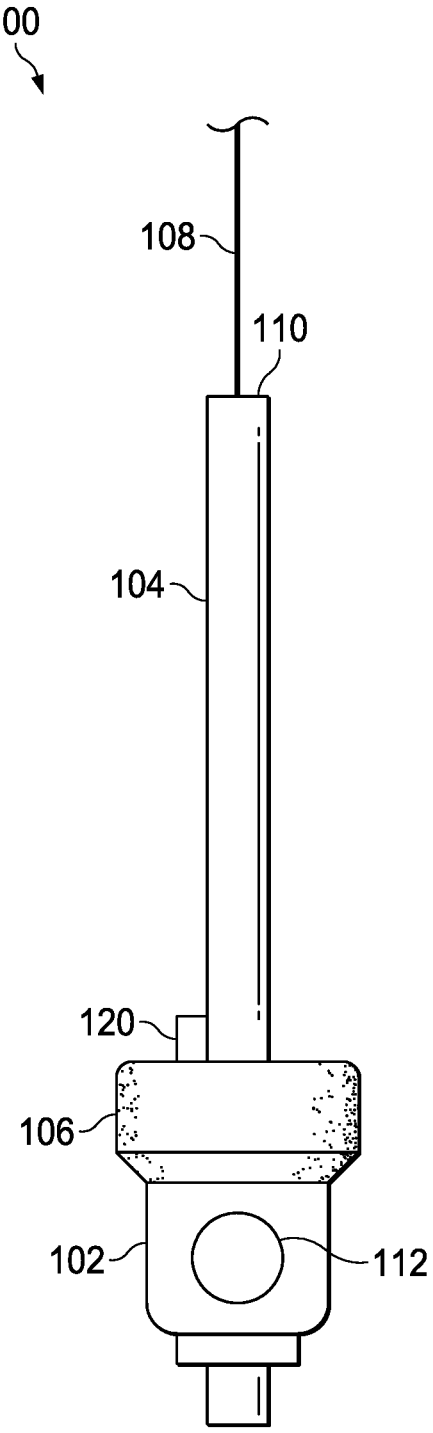
FIG. 1 is a drawing of a leak detection tool in accordance with an embodiment of the present disclosure.

FIG. 1 is a schematic illustration of a leak detection tool in accordance with an embodiment of the present disclosure. Leak detection tool 100 includes a main body 102 and a mandrel 104. A cup 106 surrounds mandrel 104 and can comprise a rubber or other elastomer material.

Figure 2A:
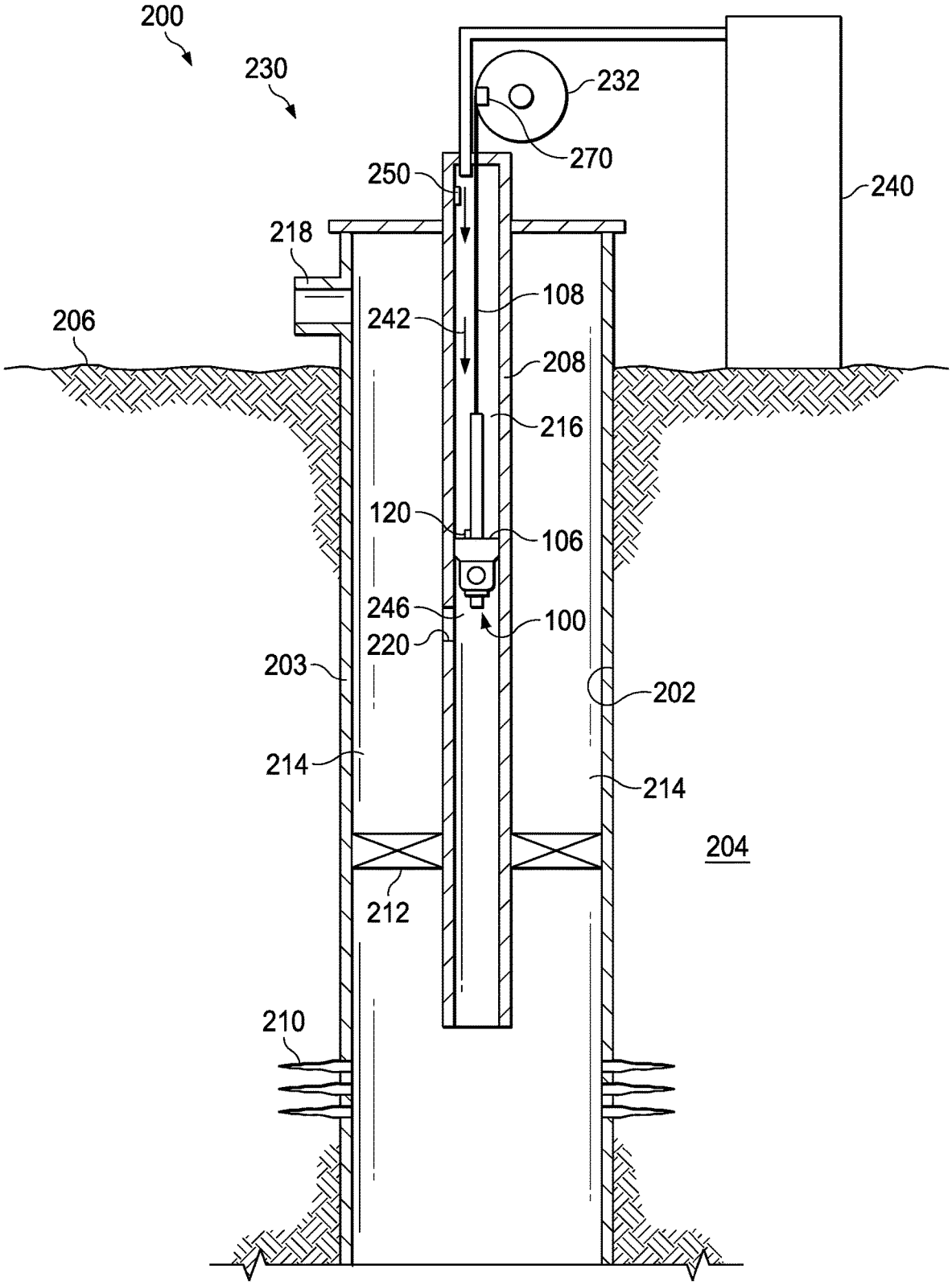
FIG. 2A is a schematic illustration of a well system with a leak detection system in accordance with an embodiment of the present disclosure.
Figure 2B:
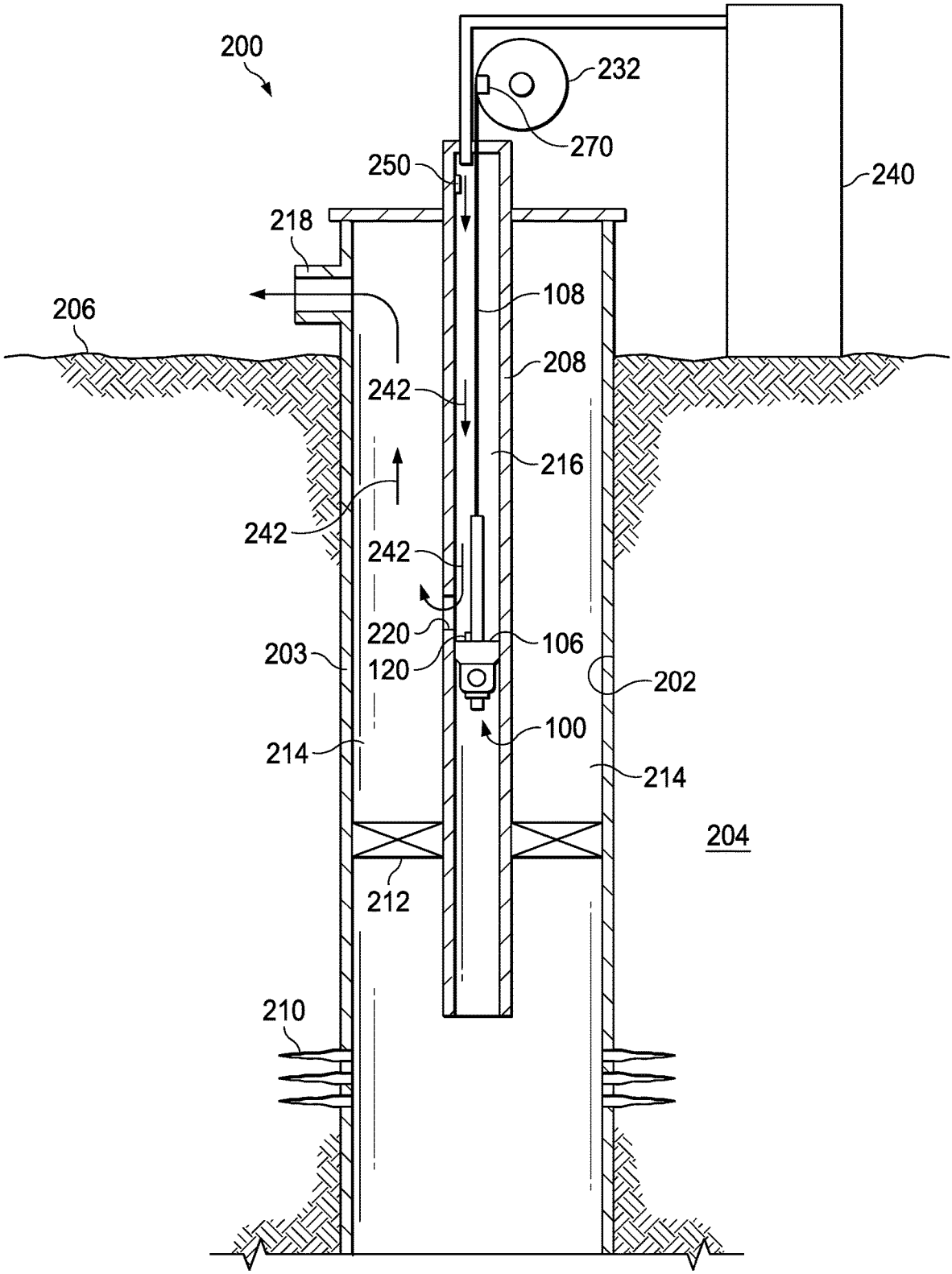
FIG. 2B is a schematic illustration of a well system with a leak detection system, as the leak detection tool passes a leak, in accordance with an embodiment of the present invention.

In an embodiment of the present disclosure, and as described in greater detail in reference to FIGS. 2A and 2B, leak detection tool 100 is sized to fit within a production tubing string, and cup 106 is sized such that the outside diameter of cup 106 is substantially the same as the inside diameter of the tubing string. As used herein, "substantially the same as the inside diameter of the tubing string" can mean that the diameter of cup 106 is the same as the inside diameter of the tubing string or that the diameter of cup 106 is slightly larger than the inside diameter of the tubing string, such that the elastomeric properties of the cup allow the cup to compress as it is inserted into the tubing string and thereby form a seal against the flow of fluids.

As described in greater detail in reference to FIGS. 2A and 2B, a downhole end of a slickline or other line 108 is attached to the uphole end 110 of mandrel 104. An uphole end of line 108 can be attached to a spool or other suitable conveyance.

In the illustrated embodiment, leak detection tool 100 further comprises a circulation port 112 which can selectively allow fluid to pass through the tool. When circulation port 112 is closed and leak detection tool 100 is disposed within a tubing string (such that cup 106 seals against the inner surface of the tubing string), fluid cannot flow (or only a very small amount of fluid can flow) from the region uphole of the tool to the region downhole of the tool or vice versa. When circulation port 112 is open, fluid can flow from the region uphole of the tool to the region downhole of the tool (or vice versa) via an interior fluid pathway (not shown) within main body 102 and/or cup 106. Circulation port 112 can be opened to prevent swabbing of the well when leak detection tool 100 is pulled in an uphole direction within the tubing string (for example, when leak detection tool is pulled by line 108 to remove leak detection tool 100 from the well).

In some embodiments, leak detection tool 100 includes a jar-activated shear pin (not shown) to open circulation port 112, such that circulation port 112 can be opened by jarring leak detection tool 100; i.e., by applying a sudden upwards force on line 108. In other embodiments, circulation port 112 can be opened or closed by other suitable devices or methods.

In some embodiments, leak detection tool 100 includes a tool sensor unit 120 disposed on the tool uphole of cup 106 which can include one or more sensors. In some embodiments, tool sensor unit 120 includes a temperature sensor and is positioned such that it can measure the temperature of fluids in the space above cup 106. In some embodiments, tool sensor unit 120 includes a pressure sensor and is positioned such that it can measure the pressure of fluids in the space above cup 106. In some embodiments, tool sensor unit 120 includes both a temperature sensor and a pressure sensor. In some embodiments, tool sensor unit 120 can include additional and/or other kinds of sensors. Measurements from the sensor(s) of tool sensor unit 120 and/or other sensors on leak detection tool 100 can be transmitted via a wired connection (for example, via line 108) or wireless connection to a surface control unit (not shown) and/or stored in a memory module disposed on or in leak detection tool 100. In some embodiments, leak detection tool 100 does not include any sensors.

FIGS. 2A and 2B are schematic illustrations of a leak detection system in a well system in accordance with an embodiment of the present disclosure.

Referring to FIG. 2A, well system 200 includes a wellbore 202 drilled from the surface 206 of the Earth into a subterranean formation 204. A casing 203 or other liner wellbore is cemented into wellbore 202 to stabilize and isolate wellbore 202. A production tubing string 208 is disposed within casing 203, such that an annulus 214 is defined by the exterior of tubing string 208 and the interior of casing 203. Wellbore 202 intersects the surface 206 at an uphole end of wellbore 202.

Perforations 210 allow hydrocarbons or other produced fluids to flow into the wellbore 202. A packer 212 seals annulus 214 above perforations 210 such that hydrocarbons and/or other fluids produced from subterranean formation 204 flow up production tubing string 208 to the surface.

A side outlet 218 at the surface can in some embodiments be opened to allow fluid flow out of annulus 214 or other access to annulus 214 if necessary.

In normal operations, tubing interior 216 of tubing string 208 should provide a fully isolated flow path for hydrocarbons to reach to the surface. However, in the illustrated example, a leak 220 has formed in the wall of tubing string 208 such that some amount of fluids can flow through the leak, out of tubing interior 216 and into annulus 214 (or out of annulus 214 and into tubing interior 216). Such a leak can be due to corrosion or other factors, and can reduce production rates and/or cause other problems with the wellbore equipment and operations.

As illustrated in FIGS. 2A and 2B, a leak detection system 230 has been added to well system 200, in accordance with an embodiment of the present disclosure. Leak detection system 230 in the illustrated embodiment includes leak detection apparatus 100 and line 108 as described in reference to FIG. 1, and also a spool 232, pump 240, pressure sensor 250, and weight sensor 270. As described in greater detail below, leak detection system 230 can be used to ascertain the existence of and/or determine the location (depth) of leak 220 and/or other leaks in tubing string 208. Ascertaining the existence of leak 220 and/or determining its location (i.e., its depth within tubing string 208) can enable an operator to initiate corrective action such as a leak patch, tubing replacement, or other suitable actions.

Leak detection tool 100 is disposed within tubing string 208. A downhole end of line 108 is attached to an uphole end of leak detection tool 100, and the uphole end of line 108 is attached to spool 232 disposed proximate to the uphole end of wellbore 202. Spool 232 includes sufficient line 108 to lower leak detection tool 100 down past any suspected tubing leaks. Spool 232 also includes a line counter or other measurement apparatus (not shown) to measure the length of the line between spool 232 and leak detection tool 100 as leak detection tool 100 is lowered into tubing string 208. Spool 232 can include a motor to rotate the spool to lower or raise leak detection tool 100.

Pump 240 is configured to pump fluid 242 into tubing string 208. Fluid 242 can comprise a circulating or drilling fluid (such as an oil-or water based drilling fluid) or other suitable fluid (such as brine).

In some embodiments, pressure sensor 250 is disposed within the interior 216 of tubing string 208 at or proximate to the uphole (surface) end of wellbore 202 and is operable to measure the surface pressure of the fluid in the interior 216 of tubing string 208 and to detect fluctuations in such pressure. In some embodiments, pressure sensor 250 can be placed at a different location within tubing string 208. In some embodiments, more than one pressure sensor can be positioned at the same or different locations within tubing string 208 and/or on leak detection tool 100. In some embodiments, pressure data from pump 240 (for example, from a pressure sensor on or within pump 240) can provide information regarding the pressure within tubing string 208 (as fluidically connected to pump 240) and can be used instead of, or in addition to, a separate pressure sensor positioned within tubing string 208. Weight sensor 270 can be positioned on spool 232 and is operable to measure the weight of leak detection tool 100 plus the weight of line 108 deployed between spool 232 and leak detection tool 100. In some embodiments, a weight sensor or other weight measuring means operable to measure such weight is an integral part of spool 232 and no separate weight sensor component is necessary.

In the illustrated embodiment, leak detection tool 100 includes a tool sensor unit 120 that can include one or more sensors as described above in reference to FIG. 1. In some embodiments, tool sensor unit 120 includes a temperature sensor operable to measure the temperature of the fluid within annulus 214 above cup 106. In some embodiments, tool sensor unit 120 includes a pressure sensor operable to measure the pressure of the fluid within annulus 214 above cup 106. In some embodiments, tool sensor unit 120 comprises multiple sensors and, in some embodiments, can include both a pressure sensor and a temperature sensor. In some embodiments, leak detection tool 100 includes no tool sensor unit 120.

In the illustrated embodiment, the leak detection system 230 includes pressure, temperature, and weight sensors as described above. In other embodiments, only one or two of the three kinds of sensors can be included. For example, in some embodiments, only pressure sensor 250 is included (and no tool sensor unit 120 and no temperature or weight sensor). In some embodiments, tool sensor unit 120 includes a pressure sensor and no pressure sensor 250 attached to the interior of the tubing string is included. In some embodiments, additional and/or different sensors can be included.

In operation, pump 240 pumps fluid into the interior 216 of tubing string 208. As also described in reference to FIG. 1, the outside diameter of cup 106 of leak detection tool 100 is substantially the same as the inside diameter of tubing string 208, thus forming a seal. Circulation port 112 can be closed to prevent any flow of fluid through the tool. The fluid pressure uphole of the cup 106 as fluid 242 is pumped will therefore greater than a fluid pressure downhole of the cup. This pressure differential propels leak detection tool 100 in a downhole direction within tubing string 208.

As leak detection tool 100 is propelled downhole, various parameters can be monitored using the sensor as described above, such as the fluid pressure within tubing string 208 measured by pressure sensor 250 and/or by tool sensor unit 120. In some embodiments, fluid 242 is pumped at a constant or substantially constant rate, such that such pressure readings can remain substantially constant as leak detection tool 100 travels (assuming leak detection tool 100 has not yet reached leak 220).

In some embodiments, temperature of fluid within the interior 216 of tubing string 208 proximate to leak detection tool 100 (uphole of cup 106) can be monitored by a temperature sensor (that is part of tool sensor unit 120) as leak detection tool 100 is propelled downhole. Likewise, the weight on weight sensor 270 can be monitored and would be expected to steadily increase as line unspools from spool 232 as the tool travels.

For so long as leak detection tool 100 is positioned uphole of leak 220, fluid 242 uphole of the cup is prevented from flowing through the leak by the cup seal. In other words, any flow through leak 220 would be from fluid below cup 106 as long as cup 106 remains above the leak 220.

FIG. 2B is a schematic illustration of a well system with a leak detection system, as the leak detection tool passes leak 220, in accordance with an embodiment of the present invention. As shown in FIG. 2B, as leak detection tool 100 travels past the leak and continues to move, the pumped fluid can flow from the interior 216 of the tubing string uphole of the cup to an exterior of the tubing string through the leak. Changes in the monitored parameters can be used to detect the moment in time or the time period at which such fluid from uphole of the cup first flows through the leak. For example, in some embodiments, pressure measurements from pressure sensor 250 and/or tool sensor unit 120 can reflect a relatively sudden change (such as a decrease) in pressure in the interior 216 uphole of cup 106 at such moment or time period that the leak detection tool 100 passes leak 220.

In some embodiments, tool sensor unit 120 includes a temperature sensor and readings from the temperature sensor can reflect a change in temperature in the fluid flowing proximate to tool 100 at such moment or time period that the leak detection tool 100 passes leak 220. In some embodiments, readings from weight sensor 270 can reflect a decrease in the weight (or a decrease in the rate of weight increase) as the fluid pressure against cup 106 decreases due to fluid escaping through leak 220 at such moment or time period that the leak detection tool 100 passes leak 220. The magnitude of the change in the monitored parameters (for example, pressure, temperature, and/or weight) can depend on factors such as the size and depth of the leak, the pump rate, and the fluid type.

The depth of leak 220 can be determined based on a length of the line 108 from the spool 232 to the leak detection tool 100 when the flow of fluid from uphole of the cup 106 through the leak 220 is first detected (i.e., at the moment or time period the flow through the leak is first detected using the pressure, temperature, and/or weight measurements as described above). In some embodiments, such length can be determined by monitoring the length of the line using a line counter or other suitable device, and marking or noting the length as the pressure, temperature, and/or weight change is detected. In some embodiments, such detection of flow through the leak can be done by observing measurements and tracking line length in real time as the tool travels downhole. In some embodiments, such detection of flow through the leak and depth determination can be done by reviewing pressure (and/or temperature and/or weight) measurement logs after the fact.

In some embodiments, the tool continues to move past the leak as pumping continues. In some embodiments, the change in pressure caused by the leak detection tool 100 passing the leak (and thereby allowing flow through the leak) is sufficient to stop the tool from travelling in a downhole direction.

In some embodiments, pressure, temperature, and weight are all used in conjunction to determine and confirm the depth of the leak. For example, in some embodiments, a pressure change can indicate to the operator the existence of a leak and its depth, and the operator can then review a log of temperature measurements and/or weight measurements (if such sensors are part of the system) to see if there are any changes as the tool has progressed downhole and thus confirm the depth of the leak using the additional data. In some embodiments, only one or two of these measured parameters (pressure, temperature, or weight) are used to determine and/or confirm the depth of the leak. In some embodiments, additional or different monitored parameters can be used. In some embodiments, readings from multiple pressure or other sensors can be correlated to confirm leak detection. In some embodiments, leak detection tool 100 can be raised and lowered multiple times and the changes in the parameters monitored with each trip so as to confirm the existence and location of a leak. For example, in an embodiment, if a leak is initially suspected at a certain depth based on a detected change in pressure, the tool can be raised a short distance above that depth (by pulling steadily on line 108) and the tool propelled downhole again by the pumping action of pump 240 (as described above) and the process repeated as the pressure (and/or other parameters) are carefully monitored such that the existence and depth of the leak can be confirmed.

After the depth of leak 220 is determined, leak detection tool 100 can be retrieved from the hole by pulling upwards on line 108 (for example, by reversing the rotation of spool 232). Before retrieval, circulation port 112 can be opened to allow fluid to travel through the tool (i.e., to allow fluid to flow from uphole of the cup to downhole of the cup), so as to avoid swabbing the well as the tool is retrieved. In some embodiments, circulation port 112 is opened by jarring action which activates a shear pin which opens the port.

Figure 3:
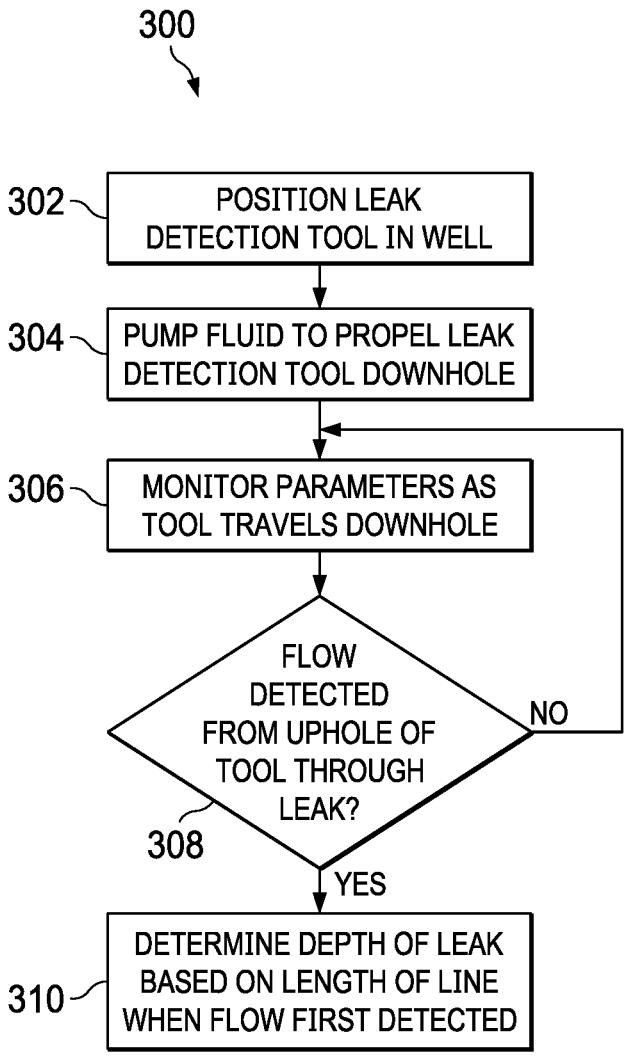
FIG. 3 is a process flow diagram of a method for leak detection in accordance with an embodiment of the present disclosure.

FIG. 3 is a process flow diagram of a method 300 for detecting a leak in a tubing string in accordance with an embodiment of the present disclosure. Method 300 will be described in reference to the elements described in reference to the leak detection tool 100 of FIG. 1 and leak detection system FIGS. 2A-2B; however, it will be understood that other suitable tools and components can be used.

Method 300 begins at step 302 wherein leak detection tool 100 is disposed in a tubing string 208 disposed in a wellbore 202. As described above, leak detection tool 100 includes a cup having an outside diameter that is substantially the same as an inside diameter of the tubing string. A downhole end of the line is attached to an uphole end of the tool and an uphole end of the line is attached to a spool disposed proximate to an uphole end of the wellbore.

At step 304, fluid is pumped into the tubing string to propel the leak detection tool in a downhole direction.

At step 306, system parameters such as fluid pressure within the tubing string uphole of the tool, temperature within the annulus exterior of the tubing string, and/or weight of the deployed length of line and tool are monitored for indications that fluid is starting to flow from an interior of the tubing string uphole of the cup to an exterior of the tubing string (i.e., the annulus) through a leak in a wall of the tubing string as the cup passes the leak. Such monitoring can be as described above in reference to FIGS. 2A and 2B. In some embodiments, additional and/or different suitable parameters can be monitored. At step 308, if changes in the parameters indicate that such flow is not occurring (for example, if the fluid pressure remains constant), then the method returns to step 306 and the operator continues to monitor the parameters.

If at step 308 changes in the parameters indicate that fluid is starting to flow from an interior of the tubing string uphole of the cup to an exterior of the tubing string, then the method proceeds to step 310 wherein the operator determines the depth of the leak based on a length of the line from the spool to the leak detection tool when the flow of fluid from uphole of the cup through the leak is first detected.

In this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

While this disclosure contains many specific implementation details, these should not be construed as limitations on the subject matter or on what may be claimed, but rather as descriptions of features that may be specific to particular implementations. Certain features that are described in this disclosure in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Nevertheless, it will be understood that various modifications, substitutions, and alterations may be made. While operations are depicted in the drawings or claims in a particular order, this should not be understood as requiring that such operations be performed in the particular order shown or in sequential order, or that all illustrated operations be performed (some operations may be considered optional), to achieve desirable results. Accordingly, the previously described example implementations do not define or constrain this disclosure.

The invention claimed is:

1. A method comprising:

positioning a leak detection tool in a tubing string disposed in a wellbore, the leak detection tool attached to a downhole end of a line and comprising a cup, wherein an outside diameter of the cup is substantially the same as an inside diameter of the tubing string and wherein an uphole end of the line is attached to a spool disposed proximate to an uphole end of the wellbore, and wherein the leak detection tool further comprises a circulation port configured to selectively allow fluid to flow from uphole of the cup to downhole of the cup;

propelling the leak detection tool through the tubing string in a downhole direction by pumping a fluid down the tubing string such that a fluid pressure uphole of the cup is greater than a fluid pressure downhole of the cup, wherein the circulation port is closed as the leak detection tool is propelled in the downhole direction;

detecting a flow of the fluid from an interior of the tubing string uphole of the cup to an exterior of the tubing string through a leak in a wall of the tubing string as the cup passes the leak;

determining a depth of the leak based on a length of the line from the spool to the leak detection tool when the flow of fluid from uphole of the cup through the leak is first detected;

opening the circulation port after the depth of the leak is detected; and pulling the leak detection tool in an uphole direction with the line.

2. The method of claim 1, wherein detecting the flow of the fluid from uphole of the cup through the leak comprises detecting a change in fluid pressure in the interior of the tubing string uphole of the cup.

3. The method of claim 1, wherein detecting the flow of the fluid from uphole of the cup through the leak comprises detecting a change in the temperature of fluid flowing in the interior of the tubing string uphole of the cup.

4. The method of claim 1, wherein detecting the flow of the fluid from uphole of the cup through the leak comprises detecting a change in a pump rate of the pumping.

5. The method of claim 1, wherein detecting the flow of the fluid from uphole of the cup through the leak comprises detecting a change in a weight on the line.

6. The method of claim 1, wherein the line is a slickline.

7. The method of claim 1, wherein the cup is an elastomer cup.

8. The method of claim 1, wherein the fluid is pumped at a substantially constant rate.

9. A system comprising:

a leak detection tool disposed in a tubing string in a wellbore, the leak detection tool comprising:

a cup, wherein an outside diameter of the cup is substantially the same as an inside diameter of the tubing string, a circulation port configured to selectively allow fluid to flow from uphole of the cup to downhole of the cup; and a sensor unit disposed on the tool uphole of the cup and comprising one or more sensors; and a jar-activated shear pin operable to open the circulation port;

a line having an uphole end and a downhole end, wherein the uphole end is attached to a spool disposed proximate to an uphole end of the wellbore and the downhole end is attached to the leak detection tool; and a pump to pump fluid into the tubing string uphole of the leak detection tool and thereby propel the leak detection tool through the tubing string in a downhole direction and past a leak in the tubing string.

10. The system of claim 9, wherein the sensor unit comprises a pressure sensor configured to measure a pressure of the fluid in an interior of the tubing string uphole of the leak detection tool.

11. The system of claim 9, wherein the sensor unit comprises a temperature sensor configured to measure a temperature of fluid flowing in the interior of the tubing string uphole of the cup in an exterior of the tubing string.

12. The system of claim 9, further comprising a line weight sensor configured to measure the weight of the line and leak detection tool as the leak detection tool is propelled downhole.

13. The system of claim 9, wherein the line is a slickline.

14. The system of claim 9, wherein the cup is an elastomer cup.

15. The system of claim 9, wherein the leak detection tool further comprises a mandrel attached to the cup, and wherein the line is attached to an uphole end of the mandrel.

* * * * *